US006860117B2

(12) United States Patent
Turpanjian et al.

(10) Patent No.: US 6,860,117 B2
(45) Date of Patent: Mar. 1, 2005

(54) COMBINATION JEWELRY SETTING AND PRECIOUS STONE

(75) Inventors: Nishan Turpanjian, Palisades Park, NJ (US); Berch Turpanjian, Palisades Park, NJ (US)

(73) Assignee: Aurelian, Inc., New York, NY (US)

( * ) Notice: Subject to any disclaimer, the term of this patent is extended or adjusted under 35 U.S.C. 154(b) by 0 days.

(21) Appl. No.: 10/446,221

(22) Filed: May 28, 2003

(65) Prior Publication Data

US 2003/0221453 A1 Dec. 4, 2003

Related U.S. Application Data

(60) Provisional application No. 60/385,137, filed on May 30, 2002.

(51) Int. Cl.[7] ..... A44C 17/02
(52) U.S. Cl. ..... 63/26; 63/27
(58) Field of Search ..... 63/26, 27; D11/36, D11/35, 91, 92

(56) References Cited

U.S. PATENT DOCUMENTS

| | | | | | |
|---|---|---|---|---|---|
| 114,370 | A | * | 5/1871 | Ladd | 206/547 |
| D35,163 | S | * | 10/1901 | Selmeier | D11/36 |
| D35,741 | S | * | 2/1902 | Wittstein | D11/92 |
| 694,594 | A | * | 3/1902 | Wittstein | 63/27 |
| D36,619 | S | * | 11/1903 | Wittstein | D11/36 |
| D36,622 | S | * | 11/1903 | Wittstein | D11/92 |
| 743,367 | A | * | 11/1903 | Wittstein | 63/27 |
| D40,005 | S | * | 5/1909 | Belasco | D11/92 |
| 1,064,152 | A | * | 6/1913 | Meyer | 63/27 |
| D48,763 | S | * | 3/1916 | Roede | D11/34 |
| D50,762 | S | * | 5/1917 | Sheff | D11/36 |
| D51,891 | S | * | 3/1918 | Simmons | D11/36 |
| 1,313,052 | A | * | 8/1919 | Bauman | 63/26 |
| D58,609 | S | * | 8/1921 | Mayer | D11/92 |
| D60,495 | S | * | 2/1922 | Kreisler | D11/36 |
| D67,743 | S | * | 7/1925 | Brod | D11/35 |
| 2,070,157 | A | * | 2/1937 | Dinhofer | 63/27 |
| 2,184,749 | A | * | 12/1939 | Manne et al. | 63/27 |
| D119,860 | S | * | 4/1940 | Karr | D11/92 |
| D137,743 | S | * | 4/1944 | Frackman | D11/36 |
| D152,468 | S | * | 1/1949 | Gaertner | D11/92 |
| 3,014,354 | A | * | 12/1961 | McCary | 63/27 |
| 5,090,217 | A | * | 2/1992 | Beber et al. | 63/27 |
| D432,447 | S | * | 10/2000 | Takessian | D11/92 |
| 2002/0166337 | A1 | * | 11/2002 | Cohen | 63/26 |
| 2003/0188550 | A1 | * | 10/2003 | Oki et al. | 63/26 |

* cited by examiner

*Primary Examiner*—Robert J. Sandy
*Assistant Examiner*—Thomas Ho
(74) *Attorney, Agent, or Firm*—Akin Gump Strauss Hauer & Feld, LLP

(57) ABSTRACT

A combination of a precious stone and a jewelry setting having a plurality of heart-shaped supporting members each having a first end having a double lobe shape and a second end having a generally pointed shape and a maximum width intermediate the first and second ends. The supporting members are connected to one another in series at a position proximate the maximum width to form an endless support structure. The precious stone is mounted within the support structure.

7 Claims, 1 Drawing Sheet

COMBINATION JEWELRY SETTING AND PRECIOUS STONE

CROSS-REFERENCE TO RELATED APPLICATIONS

This application claims the benefit of U.S. Provisional Patent Application No. 60/385,137, filed May 30, 2002.

BACKGROUND OF THE INVENTION

This invention relates to the art of jewelry settings and, more particularly, to a jewelry setting which utilizes heart-shaped supporting members to support a precious stone in a manner which enhances the brilliance of the stone and which provides the illusion of a larger precious stone.

Two factors which affect the cost of precious stones in general and of diamonds in particular are the size and the brilliance of the precious stone. It is therefore desirable for the setting in which the precious stone is affixed to maximize the appearance of the size and the brilliance of the precious stone. Various techniques are known to achieve these objectives. In a bezel setting, the girdle of the precious stone is captured continuously about its circumference by a rim or collar. The back of the setting may be open or closed. One advantage of a bezel setting is that material surrounding the precious stone provides the illusion of a larger stone. A disadvantage of a typical bezel setting is that the material surrounding the sides of the precious stone tends to limit the amount of light admitted into the precious stone, which in turn limits the brilliance of the precious stone. A second common setting design is the prong setting, in which typically 4 to 6 prongs extend from a base. The prongs are bent over the crown of the precious stone, capturing the girdle of the precious stone between the prongs and the base. The base may be open or closed. An advantage of the prong setting is that it typically has limited material on the sides to prevent light from entering the precious stone, and thus the brilliance of the precious stone is enhanced. The primary disadvantage of the prong setting is that very limited material on the sides of the precious stone does not tend to enhance the apparent size of the precious stone.

In recognition of the limitations of the existing approaches, the present heart-shaped jewelry setting has been developed to provide a setting which simultaneously creates the illusion of a larger precious stone while also enhancing the brilliance of the precious stone.

SUMMARY OF THE INVENTION

Briefly stated, the present invention is directed to a combination of a jewelry setting and a precious stone. The jewelry setting has a plurality of heart-shaped supporting members each having a first end having a double lobe shape and a second end having a generally pointed shape and a maximum width intermediate the first and second ends. The supporting members are connected to one another in series at a position proximate the maximum width to form an endless support structure. The precious stone is mounted within the support structure.

BRIEF DESCRIPTION OF THE SEVERAL VIEWS OF THE DRAWINGS

The following detailed description of the preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
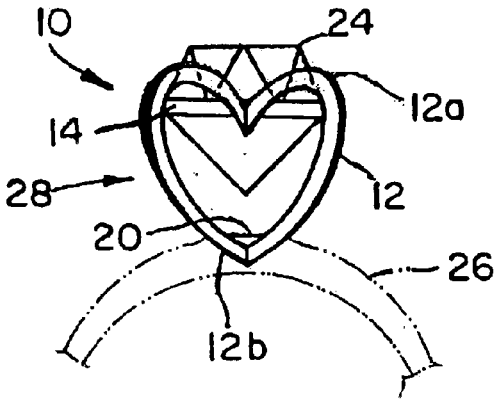
FIG. 1 is a front elevational view of a combination of a heart-shaped jewelry setting and a precious stone in accordance with a preferred embodiment of the present invention.

Certain terminology is used in the following description for convenience only and is not limiting. The words "right", "left", "top", and "bottom" designate directions in the drawings to which reference is made. The words "interior" and "exterior" refer to directions toward and away from, respectively, the geometric center of the combined jewelry setting and precious stone and designated parts thereof. The terminology includes the words above specifically mentioned, derivatives thereof and words of similar import.

Referring to the figures, wherein like numerals are used to indicate like elements throughout, there is shown in FIGS. 1–5, a preferred embodiment of a combination of a heart-shaped jewelry setting, generally designated 10, and a precious stone 24 in accordance with the present invention. The jewelry setting 10 includes a plurality of heart-shaped supporting members 12. The jewelry setting 10 illustrated depicts four supporting elements 12, however from this disclosure, those skilled in the art will recognize that the present invention is not limited to a jewelry setting 10 which uses four supporting members 12, but that more or fewer supporting members 12 could be used to form the jewelry setting 10. Each supporting member has a first end 12*a* having a generally double lobe shape and a second end 12*b* having a generally pointed shape. Each supporting element 12 also has a maximum width W intermediate the first end 12*a* and second end 12*b*.

Referring now to FIGS. 1–5, the supporting members 12 are arranged circumferentially around an inner support ring 14, and form connections 16 with both the adjacent supporting members 12 and with the inner support ring 14 at points generally along the maximum width W of the supporting members 12 at a position intermediate the first ends 12*a* and the second ends 12*b*. The supporting members 12 thus form an endless support structure 28. The first ends 12*a* of the supporting members 12 also connect to an outer circumference 14*a* of the inner support ring 14 where the double lobes meet. The support ring 14 has an inner circumference 14*b*. The second ends 12*b* of the supporting members 12 also attach to a base member 20. The combination of the jewelry setting 10 and the precious stone 24 may be attached to an item of jewelry, for example a ring 26, shown in phantom in FIGS. 1, 2, 3 and 5. From this disclosure, the artisan would recognize that the base member 20 may be omitted, and the jewelry setting 10 may be mounted directly to an item of jewelry at the second ends

12*b*. The jewelry setting 10 is formed preferably from alloys of precious metals (such as gold) using fabrication techniques (for example, brazing) well known to those skilled in the art. The precious stone 24 is fixed within the jewelry setting 10 and the jewelry setting 10 affixed to the ring 26 using techniques well known to those skilled in the art. The precious stone 24 is preferably a gemstone, such as a diamond.

It would be obvious to one skilled in the art from this disclosure that other materials (for example, platinum), fabrication techniques (for example, machining), other precious stones (for example, rubies), other types of jewelry (for example, necklaces or earrings), or other relative proportions of the jewelry setting 10 components (for example, a thinner inner support ring 14) could be substituted for the material, fabrication techniques, precious stone, type of jewelry, and relative proportions shown in the preferred embodiment of the jewelry setting 10 shown without departing from the spirit and scope of the invention.

Figure 2:
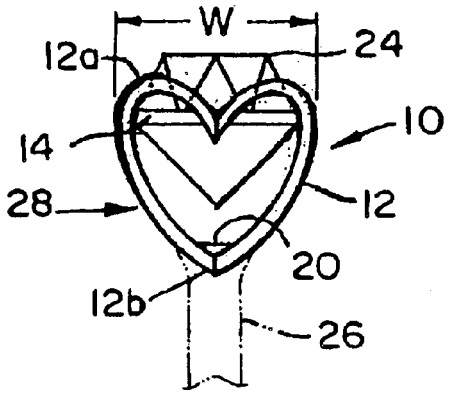
FIG. 2 is a right-side elevational view of the combination of FIG. 1.
Figure 3:
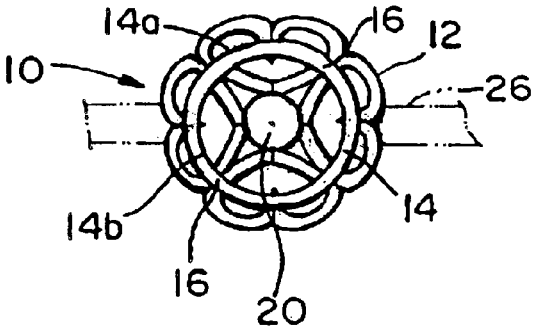
FIG. 3 is a top plan view of the heart-shaped jewelry setting of FIG. 1, with the precious stone omitted for clarity.
Figure 4:
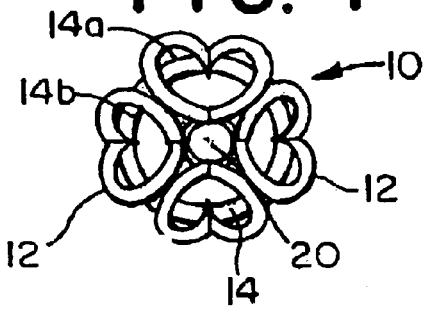
FIG. 4 is a bottom plan view of the heart-shaped jewelry setting of FIG. 1, with the attached ring and the precious stone omitted for clarity.
Figure 5:
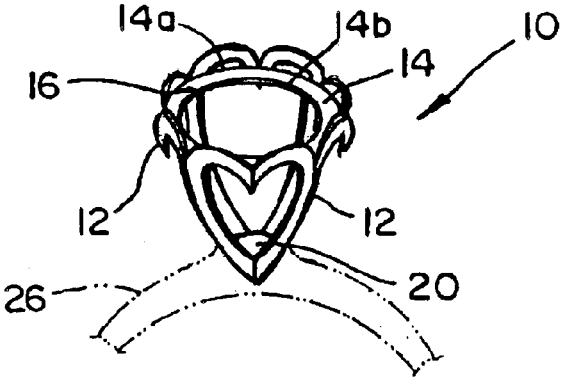
FIG. 5 is a top perspective view of the heart-shaped jewelry setting of FIG. 1, with the precious stone omitted for clarity.

In use, as illustrated in FIGS. 1 and 2, the precious stone 24 may be suspended above the base 20 of the jewelry setting 10. This in conjunction with the relatively small (compared to a bezel setting) amount of material on the sides of the jewelry setting 10 allow relatively large (again compared to a bezel setting) amounts of light to be admitted into the precious stone 24, thus enhancing its brilliance. Additionally, the tops of the support members 12 at the first ends 12*a* provide relatively large (compared to the prong setting) amounts of material surrounding the circumference of the precious stone 24, thus providing an illusion of a larger precious stone 24.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention.

We claim:

1. A combination of a jewelry setting and a precious stone, the combination comprising:

the precious stone;

the jewelry setting having a plurality of heart-shaped supporting members each having a first end having a double lobe shape and a second end having a generally pointed shape and a maximum width intermediate the first and second ends, the supporting members being connected to one another in series solely at positions substantially at the maximum width, said positions forming an endless support structure;

wherein the precious stone is directly secured to and mounted within the support structure.

2. The combination of claim 1, further comprising a generally circular support ring connected to the supporting members at a position intermediate the first and second ends proximate the maximum width of each supporting member.

3. The combination of claim 1, further comprising a base member connected to the supporting members proximate the second ends.

4. The combination of claim 1, wherein the supporting members are attached to an item of jewelry proximate the second ends.

5. The combination of claim 1, wherein the precious stone is a gemstone.

6. The combination of claim 1, wherein the precious stone is a diamond.

7. The combination of claim 4, wherein the item of jewelry is a ring.

* * * * *